United States Patent [19]

Ballato

[11] Patent Number: 4,580,116

[45] Date of Patent: Apr. 1, 1986

[54] DIELECTRIC RESONATOR

[75] Inventor: Arthur Ballato, Long Branch, N.J.

[73] Assignee: The United States of America as represented by the Secretary of the Army, Washington, D.C.

[21] Appl. No.: 699,990

[22] Filed: Feb. 11, 1985

[51] Int. Cl.[4] ..... H01P 7/10

[52] U.S. Cl. ..... 333/234; 333/219; 333/235

[58] Field of Search ..... 333/202, 204–212, 333/219, 222–235, 245, 246, 248; 29/600

[56] References Cited

U.S. PATENT DOCUMENTS

| | | | |
|---|---|---|---|
| 3,798,578 | 3/1974 | Konishi et al. | 333/229 |
| 3,919,672 | 11/1975 | Plourde | 333/234 |
| 3,924,208 | 12/1975 | Plourde | 333/234 |

OTHER PUBLICATIONS

"A Proposal of a New Dielectric Resonator Construction for MIC's", Y. Shimoda, et al., IEEE Transactions on Microwave Theory and Techniques, vol. MTT-31, No. 7, Jul. 1983, pp. 527–532. This publication discloses a dielectric resonator structure of the type from which the subject invention was developed.

*Primary Examiner*—Marvin L. Nussbaum

*Attorney, Agent, or Firm*—Anthony T. Lane; Jeremiah G. Murray; John T. Rehberg

[57] ABSTRACT

A method and means for producing a zero temperature coefficient for providing frequency stabilization as well as adjusting the frequency at a particular temperature of a dielectric resonator comprised of a cylindrical dielectric resonator element mounted on a substrate and having a dielectric disc affixed to the top of the resonator element. A zero temperature coefficient is obtained by selectively choosing the thickness of the dielectric disc depending upon the temperature coefficients of the constituent material of both the disc and resonator element. The operating frequency at a given temperature is furthermore adjusted by including two mutually contiguous patterns of metallization on the top surface of the resonator element and the bottom surface of the dielectric disc and thereafter rotating the disc so that a predetermined percentage of overlap between the two patterns exists.

14 Claims, 6 Drawing Figures

FIG.1
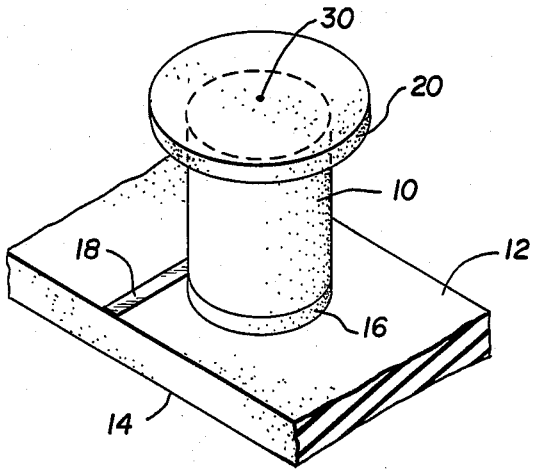
FIG.2
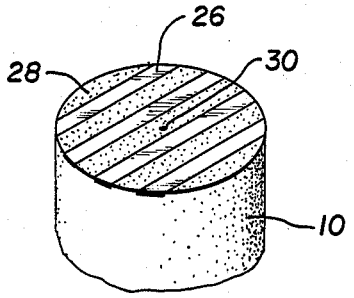
FIG.3
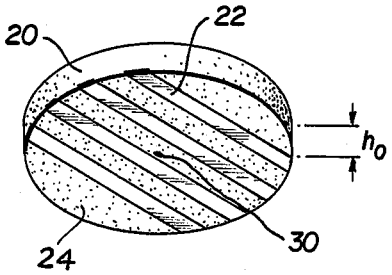
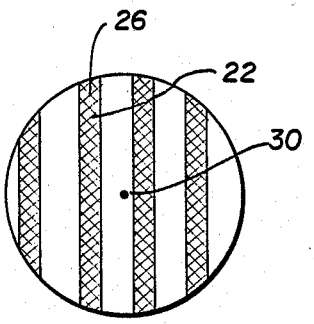
FIG.4
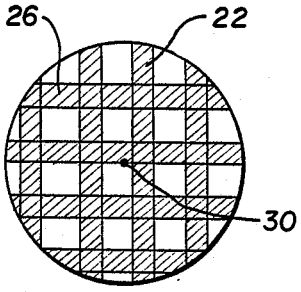
FIG.5
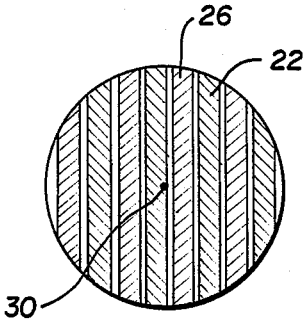
FIG.6

DIELECTRIC RESONATOR

The invention described herein may be manufactured and used by or for the Government for governmental purposes without the payment of any royalties thereon or therefor.

BACKGROUND OF THE INVENTION

1. Field of the Invention

This invention relates generally to signal oscillators and more particularly to microwave and millimeter wave oscillators comprised of dielectric resonators.

2. Description of the Prior Art

While dielectric resonators for microwave integrated circuits are well known, a relatively new dielectric resonator having relatively good temperature stability is disclosed in a publication entitled, "A Proposal of a New Dielectric Resonator Construction for MIC's", by Y. Shimoda, et al. which appeared in the *IEEE Transactions On Microwave Theory And Techniques,* Vol. MTT-31, No. 7, July, 1983 at pp. 527–532. There a dielectric resonator is disclosed consisting of a cylindrical dielectric resonator element mounted on a stripline substrate by a relatively low loss dielectric mounting element. A dielectric disc having a thin metal film applied to its upper surface is affixed to the top of the resonator element. Adjustment of the operating frequency is achieved by trimming a portion of the metallized film area from the top of the dielectric disc. Such a device, however, still nevertheless exhibits resonant frequency changes as a function of temperature.

Accordingly, it is an object of the present invention to provide an improvement in a source of microwave and millimeter wave signals.

It is another object of the invention to provide an improvement in a dielectric resonator for generating microwave and millimeter wave signals.

It is still another object of the invention to provide a dielectric resonator having improved frequency stabilization as a function of temperature.

A further object of the invention is to provide for a dielectric resonator having a zero temperature coefficient.

And still a further object of the invention is to provide an improvement in the means for tuning the dielectric resonators.

SUMMARY

Briefly, the foregoing and other objects of the invention are provided by the method and apparatus for making a dielectric resonator substantially insensitive to temperature changes and providing an improved means for independently adjusting the resonant frequency thereof. The dielectric resonator is comprised of a generally cylindrical dielectric resonator element mounted on a stripline substrate by means of a low loss dielectric mount and having a dielectric disc rotatably attached to the top surface thereof. A zero temperature coefficient is provided by selectively choosing the thickness of the disc as a function of the temperature coefficients of the materials from which both the disc and resonator elements are fabricated. Furthermore, the top surface of the resonator element and the bottom surface of the dielectric disc include separate patterns of metallization whereby rotation of the disc provides a varying area of overlap between the patterns providing thereby a variable electromagnetic field at the resonator disc interface. Such a configuration provides a means for selectively changing resonant frequency for a particular temperature.

BRIEF DESCRIPTION OF THE DRAWINGS

While the present invention is defined in the claims annexed to and forming a part of this specification, a better understanding can be had by reference to the following description when taken in conjunction with the accompanying drawings in which:

FIG. 1 is a perspective view of the preferred embodiment of the subject invention;

FIG. 2 is a partial perspective view of the dielectric resonator element of the embodiment shown in FIG. 1;

FIG. 3 is a perspective view of the underside of the dielectric disc of the embodiment shown in FIG. 1;

FIG. 4 is a schematic view of a first relative orientation between metallization patterns included on the top of the resonator element of FIG. 2 and the juxtaposed surface of the disc of FIG. 3;

FIG. 5 is a schematic view of a second relative orientation of the metallization patterns; and FIG. 6 is a schematic view of a third relative orientation of the metallization patterns.

DESCRIPTION OF THE PREFERRED EMBODIMENT

Referring now to the drawings and more particularly to FIG. 1, reference numeral 10 denotes a generally cylindrical dielectric resonator element comprised of material, having a relatively high dielectric constant, such as $BaTiO_3$ ceramic, mounted on a stripline substrate 12 comprised of, for example, alumina ceramic, the underside of which is coated with electrical conductor material 14 for acting as a ground plane. The resonator element 10 is mounted on the upper surface of the substrate 12 by means of a generally circular mounting element 16 and which is comprised of dielectric material, having a relatively low dielectric constant, such as quartz. A strip conductor 18 as shown in FIG. 1 is located on the upper surface of the substrate adjacent the mount 16 for coupling the resonator element 10 to microwave integrated circuitry, not shown, located either elsewhere on the substrate 12 or some other piece of apparatus coupled thereto. The dielectric resonator in accordance with the subject invention also includes a dielectric disc member 20, also having a relatively low dielectric constant, located on top of the dielectric resonator element 10 and has a diameter substantially larger than the cross sectional diameter of the resonator element 10 so that it acts as a support for a pattern of metallization 22 comprised of a plurality of parallel strips of metal formed on the lower surface 24 of the disc 20 and which is intended to interact with a similar pattern of metallization 26 formed on the upper surface 28 of the resonator element 10 as shown in FIG. 2.

The purpose of the patterns of metallization is to adjust the resonant frequency of the dielectric resonator shown in FIG. 1 by rotating the disc 20 with respect to the dielectric resonator element 10 about a common axis 30. The percentage of overlapping metallization is adjusted causing an alteration of the electromagnetic fields in the disc 20 and thus a shift in the frequency of the composite resonator structure. The relative overlap between the two metallization patterns 22 and 26 is shown in three different orientations in FIGS. 4, 5 and 6 by changing the metallization pattern such that they are offset from the common axis 30. One position of the disc 20 can provide a complete overlap as shown in FIG. 4 to provide a substantially 50% ratio of metallized to unmetallized surface area, whereas by rotating the disc 20° by 90°, an overlap configuration as shown in FIG. 5 is provided while a full 180° rotation provides a configuration as shown in FIG. 6 where no overlap occurs but the parallel strips of the two patterns 22 and 26 are substantially aligned with one another. Accordingly, where less metallization appears at the interface between the disc 20 and the resonator element 10, the more the device resembles a dielectric resonator whereas the more metallization makes it resemble a microwave metal cavity.

Although the configuration as shown in FIGS. 1-3 includes a symmetrical set of metallization patterns, other variations are possible. For example, the strip patterns 22 and 26 disclosed could be in the form of a fine matrix of dots or they may be comprised of a grid of lines that can be arranged to have different periodicities at different temperatures or a Moiré pattern can be provided so that the mutual area of overlap can vary over a relatively large range of temperature due to the different temperature coefficients of expansion of the resonator element 10 and disc 20. Also, when desirable, a temperature dependent angular rotation of the disc 20 with respect to the resonator element 10 can be provided, for example, by a bi-metallic strip arrangement coupled therebetween which would effect rotation as a function of temperature to provide an automatic frequency control of the resonator structure shown in FIG. 1.

Since a dielectric resonator structure as shown in FIG. 1 is normally temperature sensitive due to its being comprised of materials having widely different temperature coefficients of expansion, such a configuration can nevertheless be made to have a zero temperature coefficient by selectively choosing the thickness $h_0$ of the dielectric disc 20 as a function of the temperature coefficient of thickness expansion $\alpha_h$ of its constituent material, its thickness coefficient of frequency $H_f$, and the temperature coefficient of frequency $T_f$ of the resonator element 10 in the following manner.

For a disc thickness $h_0$, the thickness coefficient of frequency $H_f$ can be defined as:

$$H_f = \frac{1}{f_0} \cdot \frac{df}{dh}, \tag{1}$$

where $f_0$ is the resonant frequency, and df/dh is the derivative of frequency with respect to disc thickness.

The temperature coefficient of frequency for the resonator element 10 can furthermore be defined by the expression:

$$T_f = \frac{1}{f_0} \cdot \frac{df}{dT} \tag{2}$$

where df/dT is the derivative of frequency with respect to temperature.

The temperature coefficient of expansion $\alpha_h$ for the disc 20 in the thickness direction can likewise be expressed as:

$$\alpha_h = \frac{1}{h_0} \cdot \frac{dh}{dT}. \tag{3}$$

From equation (1) it can be seen that the differential of frequency is related to that of disc thickness df(h) by:

$$df(h) = H_f f_0 \cdot dh \tag{4}$$

This means a downward frequency change for an increase in dh, since Shimoda in the above referenced publication has shown experimentally that $H_f$ is a negative number. From equation (2) it can be seen that the differential of frequency is related to that of temperature df(T) by:

$$df(T) = T_f f_0 \cdot dT, \tag{5}$$

and which means an upward change in frequency for an increase in dT, since Shimoda's experimental data show $T_f$ to be a positive number. In a like manner, from equation (3) the differential of thickness is related to that of temperature dh(T) by:

$$dh(T) = \alpha_h \cdot h_0 \cdot dT, \tag{6}$$

and signifies an upward change in dh due to an increase in dT, provided $\alpha_h$ is positive.

Combining equation (6) with equation (4), one gets the expression:

$$df(h) = H_f f_0 \cdot \alpha_h \cdot h_0 \cdot dT. \tag{7}$$

For temperature compensation, the changes in frequency from equations (5) and (7) must add to zero, i.e., $$df(T) + df(h) = 0. \tag{8}$$

Accordingly, $$f_0 \cdot dT \cdot [H_f \alpha_h \cdot h_0 + T_f] = 0 \tag{9}$$

from which the temperature coefficient of thermal expansion $\alpha_h$ of the disc thickness h that will provide temperature compensation can be expressed as:

$$\alpha_h = \frac{-T_f}{h_0 \cdot H_f} \tag{10}$$

or $$h_0 = \frac{-T_f}{\alpha_h \cdot H_f} \tag{11}$$

Thus given a resonant element 10 having a relatively high dielectric constant and knowing the temperature coefficient of thermal expansion of the relatively low dielectric constant material from which the disc 20 is comprised, the disc thickness $h_0$ can be determined in accordance with equation (11) to provide a zero temperature coefficient for the combined resonant structure and thereby increase frequency stabilization as a function of temperature for the constituent material from which the resonator element 10 is fabricated. Furthermore, since $\alpha_h$ is inversely proportional to $h_0$ as shown in equation (11), by making $h_0$ smaller $\alpha_h$ will be larger and vice versa.

Thus what has been shown and described is an oscillator for microwave or millimeter wave frequencies which is relatively insensitive to temperature changes and having a novel means of adjusting the resonator absolute frequency at a given temperature. This makes such a device particularly applicable for use with microwave integrated circuits.

While the present invention has been shown and described with respect to its preferred method and embodiment, it should be noted that the foregoing detailed description is made by way of illustration and not limitation. Accordingly, all modifications, alterations, and changes coming within the spirit and scope of the invention are herein meant to be included.

I claim:

1. A method of providing temperature compensation for the resonant frequency of a dielectric resonator comprised of a first dielectric resonator member mounted on a substrate and having a second dielectric member affixed to the top of said first member, comprising the steps of:

selecting the constituent material of said first dielectric resonator member to have a relatively high dielectric constant;

selecting the constituent material of said second dielectric member to have a relatively low dielectric constant, and selecting the thickness of said second dielectric member as a linear function of the temperature coefficient of frequency of said first member and a reciprocal function of both the temperature coefficient of thickness expansion of said second member and the thickness coefficient of frequency of said second member to provide a substantially zero temperature coefficient of resonant frequency of said resonator.

2. The method of claim 1 wherein said first dielectric member comprises a generally cylindrical resonator member and said second dielectric member comprises a disc-type member.

3. The method of claim 2 wherein the step of selecting the thickness of said second dielectric member comprises selecting said thickness in accordance with the expression:

$$h_0 = \frac{-T_f}{\alpha_h \cdot H_f}$$

where $h_0$ is the thickness of said second member, $T_f$ is the temperature coefficient of frequency of said first member, $\alpha_h$ is the temperature coefficient of thickness expansion of said second member, and $H_f$ is the thickness coefficient of frequency of said second member.

4. The method of claim 2 including applying complimentary metallization patterns to the opposing surfaces between said dielectric members.

5. The method of claim 4 wherein said second dielectric member is axially rotatable with respect to said first dielectric member and rotating said second member with respect to said first member to adjust the percentage of overlap of said metallization patterns and the resonant frequency of said resonator.

6. A dielectric resonator for generating microwave and millimeter wave signals, comprising:

a dielectric substrate having first and second opposing surfaces and including a ground plane formed on said first surface;

a dielectric resonator mount having a relatively low dielectric constant located on said second surface;

a dielectric resonator element having a relatively high dielectric constant located on said resonator mount and including a first pattern of metallization formed on the upper surface thereof;

a dielectric top member having a relatively low dielectric constant located over said first pattern of metallization of said resonator element and including a second pattern of metallizatiion for interacting with said first pattern of metallization formed on one surface of said dielectric top member for adjusting the resonant frequency of said resonator.

7. The dielectric resonator as defined by claim 6 wherein said second pattern of metallization is formed on the lower surface of said top member, said top member further being movable for varying the pattern overlap of said first and second patterns of metallization.

8. The dielectric resonator as defined by claim 7 wherein said resonator element comprises a generally cylindrical member.

9. The dielectric resonator as defined by claim 8 wherein said top member comprises a disc type member of predetermined thickness.

10. The dielectric resonator as defined by claim 9 wherein said disc type member is rotatable about an axis through said cylindrical resonator member.

11. The dielectric resonator as defined by claim 10 wherein said first pattern of metallization comprises a plurality of lines of metallization having a predetermined width.

12. The dielectric resonator as defined by claim 11 wherein said second pattern of metallization also comprises a plurality of lines of metallization having a predetermined width.

13. The dielectric resonator as defined by claim 12 wherein said first and second patterns of metallization respectively comprises a plurality of parallel stripes of metallization.

14. The dielectric resonator as defined by claim 9 wherein said thickness is selected in accordance with the expression:

$$h_0 = \frac{-T_f}{\alpha_h \cdot H_f}$$

where $h_0$ is the thickness of said top member, $T_f$ is the temperature coefficient of frequency of said resonator member, $\alpha_h$ is the temperature coefficient of thickness expansion of said top member, and $H_f$ is the thickness coefficient of frequency of said top member, whereby a substantially zero temperature coefficient of resonant frequency of said resonator is provided.

* * * * *